United States Patent [19]

Reichgott

[11] Patent Number: 5,061,389

[45] Date of Patent: Oct. 29, 1991

[54] WATER SURFACE ENHANCER AND LUBRICANT FOR FORMED METAL SURFACES

[75] Inventor: David W. Reichgott, Richboro, Pa.

[73] Assignee: Man-Gill Chemical Co., Cleveland, Ohio

[21] Appl. No.: 511,123

[22] Filed: Apr. 19, 1990

[51] Int. Cl.[5] ..... C10M 173/02

[52] U.S. Cl. ..... 252/49.3; 252/52 A; 252/56 R; 252/58; 72/42

[58] Field of Search ..... 252/49.3, 52 A, 58, 252/56 R; 72/42

[56] References Cited

U.S. PATENT DOCUMENTS

| | | | |
|---|---|---|---|
| 3,124,531 | 3/1964 | Whetzel et al. | 252/52 A |
| 3,980,715 | 9/1976 | Szur | 252/52 A |
| 4,260,502 | 4/1981 | Slanker | 252/49.5 |
| 4,430,234 | 2/1984 | Hasegawa et al. | 252/52 A |
| 4,497,720 | 2/1985 | Moriga et al. | 252/52 A |
| 4,569,774 | 2/1986 | Forbus, Jr. | 252/58 |
| 4,584,116 | 4/1986 | Hermant et al. | 252/58 |
| 4,859,351 | 8/1989 | Awad | 252/32.5 |

FOREIGN PATENT DOCUMENTS

| | | | |
|---|---|---|---|
| 207504 | 3/1984 | Fed. Rep. of Germany | 72/42 |
| 83594 | 5/1982 | Japan | 252/52 A |

OTHER PUBLICATIONS

McCutcheon, "Functional Materials 1989", pp. 178, 179, 183, 184, 188, 189, 190.

*Primary Examiner*—Prince E. Willis
*Assistant Examiner*—Ellen McAvoy
*Attorney, Agent, or Firm*—Renner, Otto, Boisselle & Sklar

[57] ABSTRACT

A composition and process for reducing the coefficient of friction on the surface of formed metal structures, such as aluminum cans, by lubricating the surface with a blend of a polyethylene glycol ester with a fluoride compound.

35 Claims, 2 Drawing Sheets

WATER SURFACE ENHANCER AND LUBRICANT FOR FORMED METAL SURFACES

FIELD OF THE INVENTION

The invention relates to the manufacture of formed metal products. Specifically, the invention is directed toward reducing the coefficient of friction on the exterior surface of the metal containers, such as aluminum cans, to aid in the efficient movement of the cans through either metal forming or end product packaging equipment.

BACKGROUND OF THE INVENTION

Aluminum cans are commonly used as containers for a wide variety of products. After their manufacture, the aluminum cans are typically washed with cleaners to remove aluminum fines and other contaminants therefrom. Conventional washes frequently result in a surface finish on the outside of the can which has a deleterious effect on the efficient movement of the cans through the conveyor systems and onto or off the printer mandrels.

A need exists in the aluminum can processing industry to modify the coefficient of friction on the outside surface of the cans in order to improve their mobility without adversely affecting the adhesion of printing, paints or lacquers applied thereto. Cans characterized as having poor mobility have high coefficients of static and kinetic friction. Those practiced in the art know that the coefficient of static friction between two surfaces is almost always larger than the coefficient of kinetic friction. In a commercial can processing operation, there are numerous locations where the cans stop moving momentarily and must start again from rest. Hence the coefficient of static friction becomes limiting. The problem is particularly important when the cans are loaded on, and ejected from the mandrels of high-speed printers. Other locations where the problem is evident is where cans flow through the single file conveyors called "single filers". A high coefficient of static friction generally prohibits an increase in line speed and production speed and production output, causes frequent jammings, printer misfeed problems and loss of production due to increased rates of damage to the cans.

A reduction in the coefficient of static friction will improve can mobility through the conveyor system, especially the single filers and reduce printer rejects. This will allow for an increase in production without additional capital investment in advanced processing equipment which may be of limited benefit in any case.

It is therefore desirable to improve the mobility of aluminum cans through the conveyor filers and printers to increase production output, reduce line jammings, minimize down time and reduce can damage. It is an object of the invention to improve the mobility of aluminum through can processing equipment for the purpose of overcoming the aforementioned problems.

PRIOR ART

It is known to utilize ethoxylated fatty acids as lubricants for aluminum metalworking. These compounds, also referred to as polyethylene glycol esters, have been utilized as die lubricants in metal forming operations and as outside surface conditioners on formed products to improve the mobility of these products throughout conveyor systems.

A wide selection of commercial ethoxylated fatty acids may be found in "McCutcheon's Emulsifiers and Detergents" and "McCutcheon's Functional Fluids" (both from McPublishing Company, Glen Rock, NJ), listed under "Lubricants". Examples include Ethox ML-14 and MS-14 (Ethox Chemicals, Inc.), Kessco PEG (600) monolaurate, Kessco (600) monostearate (Stepan Co.), Mapeg 400 MS (Mazer Chemicals, Inc.), and Dyafac 6-S (Henkel Corp.). A variety of polyethylene glycol chain lengths (molecular weights) and fatty acid moieties is available in these references.

U.S. Pat. No. 4,260,502 Slanker, teaches the use of polyethylene glycol mono-and/or di-esters of carboxylic acids ($C_8$–$C_{22}$) as a lubricant to improve the formability of metal products in a metal-working operation. The invention is of particular utility in the formation of metal cans such as aluminum cans.

U.S. Pat. No. 4,859.351, Awad discloses a composition and process for reducing the coefficient of static friction on the external surface of aluminum cans consisting essentially of either an ethoxylated fatty acid, a polyethoxylated oleyl alcohol or an ethoxylated alkyl alcohol phosphate ester.

DETAILED DESCRIPTION OF THE INVENTION

Figure 1:
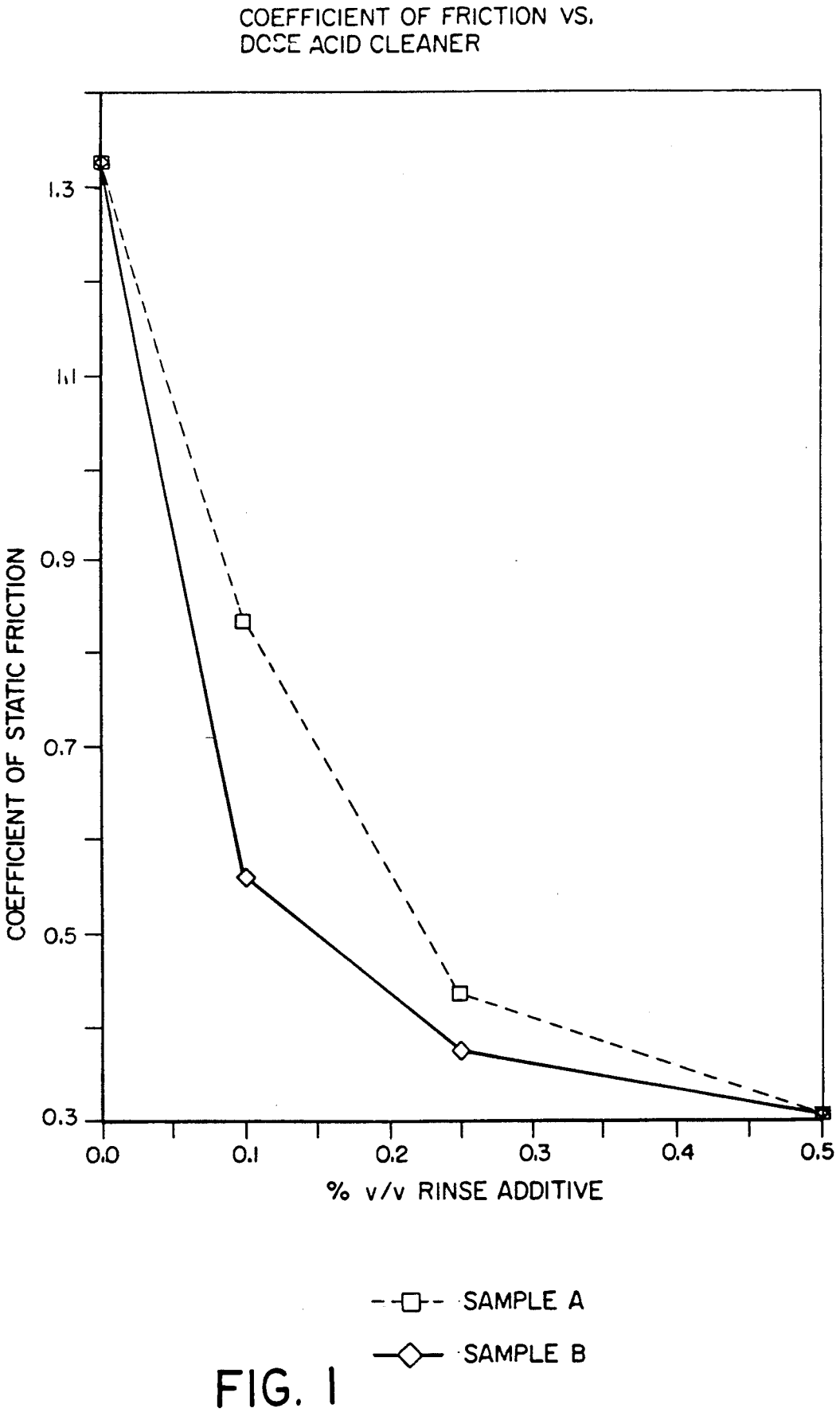
Figure 2:
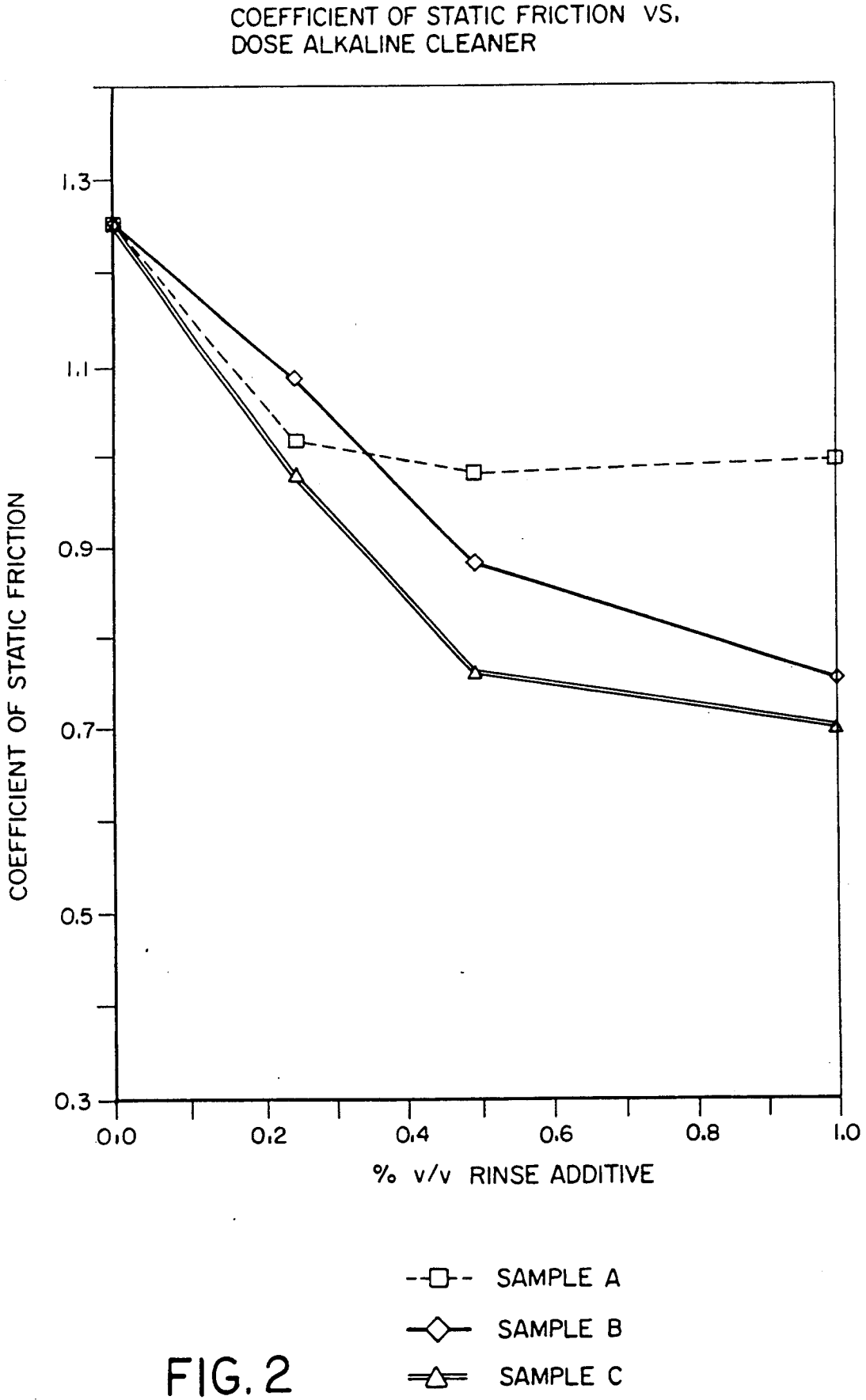

In accordance with the present invention polyethylene glycol esters are mixed with a fluoride compound to produce a lubricant that effectively reduces the coefficient of friction on the outside surface of formed metal structures such as aluminum cans. The polyethylene glycol esters are preferably the water soluble derivatives of a saturated fatty acid such as an ethoxylated stearic acid, for example, polyethylene glycol monostearate. Unsaturated fatty acids may also be utilized but are less preferable.

The fluoride compound may be provided to the polyethylene glycol ester by means of any known fluoride compound. Examples include alkali metal fluorides, such as sodium fluoride, ammonium fluoride salts, such as ammonium fluoride and ammonium bifluoride, other inorganic fluoride salts and hydrofluoric acid, HF.

The polyethylene glycol ester and fluoride are preferably blended together in an aqueous medium, such as deionized water, to form a concentrate. The ester may be added to the aqueous medium in the concentration of from about 1.0% to 10.0% by weight. Typically, however, the concentration will be from about 2.5% to about 5.0%. The fluoride is present at a much smaller dosage level, typically between about 0.01% and 0.5% by weight, as F.

The composition according to the present invention may be used with either acid or alkaline can cleaning processes. The concentrate formulated as disclosed above must be dissolved within a suitable liquid medium, preferably aqueous, before being applied to the can surface as a rinse. The diluted concentrate may then be easily sprayed onto the cans in the form of a mist. The concentrate is dissolved within the aqueous medium in a concentration of from about 0.1% v/v to about 5.0% v/v.

It should be understood that the polyethylene glycol ester and fluoride components may be added separately to the rinse water thus avoiding the preparation of a concentrate. Either method is within the purview of this invention.

EXAMPLES

Concentrates were blended using the following formulations.

Sample A 3.0% polyethylene glycol (MW=600) monostearate plus
0.5% polyethylene glycol (MW=1000) monostearate in deionized water

Sample B 3.0% polyethylene glycol (MW TM 600) monostearate plus 0.5% polyethylene glycol (MW=1000) monostearate
plus 0.06% ammonium fluoride in deionized water.

Sample C 3.0% polyethylene glycol (MW=600) monostearate plus 0.5% polyethylene glycol (MW=1000) monostearate plus
0.72% ammonium fluoride in deionized water.

Sample D 3.0% polyethylene glycol (MW=600) monolaurate plus
0.5% polyethylene glycol (MW=1000) monostearate plus
0.06% ammonium fluoride in deionized water.

Fluoride ion concentrations in spray mist solution vary with the sample chosen and its concentration in the rinse solution. This is shown in Table I.

TABLE I

| Fluoride ion concentrations (in ppm) | | | | |
|---|---|---|---|---|
| Sample concentration | Samples | | | |
| % v/v | A | B | C | D |
| 0.00 | 0 | 0 | 0 | 0 |
| 0.25 | 0 | 0.8 | 9.5 | 0.8 |
| 0.50 | 0 | 1.7 | 19.0 | 1.7 |
| 1.00 | 0 | 3.4 | 38.0 | 3.4 |

Aluminum cans were obtained from a commercial can manufacturer. They were taken after the forming process, prior to cleaning, without the separate end piece attached and with their surfaces covered with lubricant, oil and aluminum fines. The cans were spray cleaned in a laboratory spray cabinet using a solution of sulfuric acid, hydrofluoric acid and surfactants in tap water; (1.1% v/v Betz PCL 450 and 0.067% v/v Betz ACC 45 cleaners available from Betz Laboratories, Inc., Trevose, Penna.).

After cleaning for 30 seconds at 120° F., the cans received two tap water rinses, followed by a 15 second spray application of the lubricant solution in deionized water. The cans were then oven dried at 310° F. for three minutes.

Coefficients of static friction were determined using an inclined plane. In this method, two cans are placed parallel to each other with the domes (i.e., the closed ends) against a stop that is parallel to the hinge of the plane. Positioning feet retain the cans in a parallel orientation about 0.5 cm apart at the sidewalls, and they ensure reproducible placement. A third can is placed parallel to, and resting on the two other cans, with its dome end opposite to the others. The edge is offset to overhang by about 1.5 cm so the edges of the open ends are not in contact. A small mark is made at one point on the edge of the open end of each can to keep track of its rotational orientation. The plane is inclined slowly. (Manual elevation is preferred to avoid influences from vibrations of motorized devices.) The angle at which the upper can begins, and continues to slide along the lower cans is recorded. The upper can is again placed on the other two after rotation about its long axis by 90 degrees, and the process is repeated. After four measurements, the base cans are rotated about their long axes by 180 degrees, and an additional four measurements are made. The eight angles of incline are averaged. The coefficient of static friction is the tangent of this angle. These data are reported in Table II and is shown in FIG. I.

TABLE II

| Coefficient of Static Friction Acid Cleaning Process | | |
|---|---|---|
| Sample concentration | Samples | |
| % v/v | A | B |
| 0.00 | 1.327 | 1.327 |
| 0.10 | 0.833 | 0.561 |
| 0.25 | 0.437 | 0.376 |
| 0.50 | 0.306 | 0.308 |

Table III shows the relative efficacies of samples B and D in regards to the coefficient of static friction. The two samples differ only in that each contains polyethylene glycol monostearate and sample D contains different polyethylene glycol ester components; sample B contains polyethylene glycol monolaurate.

TABLE III

| Coefficient of Static Friction PEG Monostearate vs. PEG monolaurate Acid Cleaning Process | | |
|---|---|---|
| Sample concentration | Samples | |
| % v/v | A | B |
| 0.0 | 1.257 | 1.257 |
| 0.2 | .447 | .435 |
| 0.4 | .364 | .406 |
| 0.6 | .308 | .313 |

Alternatively, the lubricant of the present invention was tested under the conditions of an alkaline cleaning process. The alkaline cleaning solution contained sodium hydroxide plus chelants and surfactants in tap water (0.85% Betz DR-1369 plus 0.05% Betz DR-1370: the cleaners are available from Betz Laboratories, Inc., Trevose, Penna.). Except for the fact that the cleaning time was 60 seconds, the test procedure is identical to the procedure described above herein under the acid cleaning conditions. Results are reported in Table IV and are shown in FIG. II.

TABLE IV

| Coefficient of Static Friction Alkaline Cleaning Process | | | |
|---|---|---|---|
| Sample concentration | Samples | | |
| % v/v | A | B | C |
| 0.00 | 1.253 | — | — |
| 0.25 | 1.018 | 1.084 | 0.979 |
| 0.50 | 0.979 | 0.882 | 0.762 |
| 1.00 | 0.993 | 0.754 | 0.700 |

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

I claim:

1. A composition for lubricating the external surfaces of aluminum cans comprising a fluoride compound and a polyethylene glycol ester or mixtures of polyethylene glycol esters in an aqueous medium.

2. The composition of claim 1 wherein the concentration of said polyethylene glycol ester or mixtures of polyethylene glycol esters in said aqueous medium is from about 1.0% to about 10.0% by weight.

3. The composition of claim 1 wherein the concentration of said polyethylene glycol ester or mixtures of polyethylene glycol esters in said aqueous medium is from about 2.5% to about 5.0% by weight.

4. The composition of claim 1 wherein the concentration of said fluoride in said aqueous medium is from about 0.01% to about 0.5% by weight.

5. The composition of claim 1 wherein said polyethylene glycol ester is a water soluble derivative of a saturated fatty acid.

6. The composition of claim 5 wherein said polyethylene glycol ester in an ethoxylated stearic acid.

7. The composition of claim 5 wherein said polyethylene glycol ester is an ethoxylated lauric acid.

8. The composition of claim 5 wherein said polyethylene glycol ester is polyethylene glycol monostearate.

9. The composition of claim 5 wherein said polyethylene glycol ester is polyethylene glycol monolaurate.

10. The composition of claim 1 wherein said fluoride compound is selected from the group consisting of inorganic fluoride salts and hydrofluoric acid.

11. The composition of claim 1 wherein said fluoride compound is ammonium fluoride.

12. The composition of claim 1 wherein said fluoride compound is sodium fluoride.

13. The composition of claim 10 wherein said fluoride compound is selected from the group consisting of alkali metal fluorides.

14. The composition of claim 10 wherein said fluoride compound is an ammonium fluoride salt.

15. A process for lubricating the external surface of a formed metal structure comprising applying to said external surface a sufficient amount for the purpose of a lubricant comprising a fluoride compound and a polyethylene glycol ester or mixtures of polyethylene glycol esters.

16. A process according to claim 15 wherein said formed metal structure is an aluminum can.

17. A process according to claim 15 wherein said lubricant is dissolved in an aqueous medium in a concentration of from about 0.1% to about 5.0% by volume.

18. A process according to claim 17 wherein said aqueous medium containing said lubricant is added to the final rinse water of a can cleaning operation applied by spraying said final rinse water onto said external surface of said formed structure.

19. A process according to claim 15 wherein said lubricant is applied onto said external surface of said formed structure after said formed structure is washed by a cleaner.

20. A process according to claim 19 wherein said cleaner is an acid cleaner.

21. A process according to claim 19 wherein said cleaner is an alkaline cleaner.

22. A process according to claim 15 wherein said polyethylene glycol ester is a water soluble derivative of a saturated fatty acid.

23. A process according to claim 15 wherein said polyethylene glycol ester is an ethoxylated stearic acid.

24. A process according to claim 15 wherein said polyethylene glycol ester is an ethoxylated lauric acid.

25. A process according to claim 15 wherein said polyethylene glycol ester is polyethylene glycol monostearate.

26. A process according to claim 15 wherein said polyethylene glycol ester is polyethylene glycol monolaurate.

27. A process according to claim 15 wherein said fluoride compound is selected from the group consisting of inorganic fluoride salts and hydrofluoric acid.

28. A process according to claim 15 wherein said fluoride compound is ammonium fluoride.

29. A process according to claim 15 wherein said fluoride is sodium fluoride.

30. A process according to claim 17 wherein the concentration of said polyethylene glycol ester or mixtures of polyethylene glycol esters in said final rinse water is from about 0.001% to about 0.5%.

31. A process according to claim 17 wherein the concentration of said polyethylene glycol ester or mixtures of polyethylene glycol esters in said final rinse water is from about 0.004% to about 0.03%.

32. A process according to claim 17 wherein the concentration of said fluoride compound in said final rinse water is from about 0.3 to about 40 parts per million as F.

33. A process according to claim 17 wherein said fluoride compound and polyethylene glycol ester or mixtures of polyethylene glycol esters are added separately to said final rinse water.

34. A process according to claim 27 wherein said fluoride compound is selected from the group consisting of alkali metal fluorides.

35. A process according to claim 27 wherein said fluoride compound is an ammonium fluoride salt.

* * * * *